US008381357B2

(12) United States Patent
Zinn

(10) Patent No.: US 8,381,357 B2
(45) Date of Patent: Feb. 26, 2013

(54) DOOR HINGE, IN PARTICULAR EDGE HINGE

(75) Inventor: Jürgen Zinn, Heiligenhaus (DE)

(73) Assignee: Steinbach & Vollmann GmbH & Co. KG (DE)

( * ) Notice: Subject to any disclaimer, the term of this patent is extended or adjusted under 35 U.S.C. 154(b) by 401 days.

(21) Appl. No.: 12/446,417

(22) PCT Filed: Oct. 31, 2007

(86) PCT No.: PCT/EP2007/009438

§ 371 (c)(1),
(2), (4) Date: Apr. 20, 2009

(87) PCT Pub. No.: WO2008/061611

PCT Pub. Date: May 29, 2008

(65) Prior Publication Data

US 2010/0293747 A1 Nov. 25, 2010

(30) Foreign Application Priority Data

Nov. 23, 2006 (DE) ..... 20 2006 017 870 U

(51) Int. Cl.
*E05D 5/12* (2006.01)

(52) U.S. Cl. ..... 16/380; 16/271; 16/387; 16/250

(58) Field of Classification Search ..... 16/387, 16/243, 244, 309, 312, 313, 316, 315, 245, 16/250, 251, 380, 271, 272, 270
See application file for complete search history.

(56) References Cited

U.S. PATENT DOCUMENTS

| | | | | | |
|---|---|---|---|---|---|
| 36,976 | A | * | 11/1862 | Acker | 16/300 |
| 114,813 | A | * | 5/1871 | Hawkes | 16/256 |
| 133,699 | A | * | 12/1872 | Crawford | 16/307 |
| 1,691,759 | A | * | 11/1928 | Fischer | 16/314 |
| 2,047,909 | A | * | 7/1936 | North | 16/250 |
| 2,096,311 | A | * | 10/1937 | Strough | 16/245 |

(Continued)

FOREIGN PATENT DOCUMENTS

| | | | |
|---|---|---|---|
| DE | 21 03 345 | A1 | 8/1972 |
| DE | 2217932 | A1 | 3/1973 |

(Continued)

OTHER PUBLICATIONS

Translation of International Preliminary Report on Patentability for PCT/EP2007/009438 (Jun. 18, 2009).

*Primary Examiner* — Jeffrey O Brien
(74) *Attorney, Agent, or Firm* — Harness, Dickey & Pierce, P.L.C.

(57) ABSTRACT

A door hinge, in particular an edge hinge, which has door-mounted support and a support mounted on a door frame, both of which are designed such that they can be swiveled relative to each other around a common rotational axis. To suggest a new type of door hinge, in particular an edge hinge which allows a simplified handling, the invention suggests a door hinge, in particular en edge hinge, with a door support to be arranged on a door and a frame support to be arranged on a door frame, both of which are designed to be arranged around a common rotational axis such that they can be swiveled relative to each other, wherein the door support and the frame support are designed to be of equal construction and equally usable for left and right doors.

9 Claims, 8 Drawing Sheets

U.S. PATENT DOCUMENTS

| | | | | | |
|---|---|---|---|---|---|
| 3,134,134 | A | * | 5/1964 | McCubbin | 16/263 |
| 3,154,803 | A | * | 11/1964 | Parsons | 16/250 |
| 3,599,275 | A | * | 8/1971 | Granzow | 16/275 |
| 3,748,688 | A | | 7/1973 | Berkowitz | |
| 3,832,755 | A | * | 9/1974 | Maertin et al. | 16/309 |
| 4,030,161 | A | | 6/1977 | Loikitz | |
| 4,475,266 | A | * | 10/1984 | Suska | 16/273 |
| 4,631,777 | A | | 12/1986 | Takimoto | |
| 4,991,259 | A | | 2/1991 | Finkelstein et al. | |
| 5,025,531 | A | * | 6/1991 | McCarty | 16/313 |
| 6,141,830 | A | * | 11/2000 | Shimooka | 16/237 |
| 6,212,734 | B1 | | 4/2001 | Commons | |
| 7,000,289 | B2 | * | 2/2006 | Cedrone | 16/309 |

FOREIGN PATENT DOCUMENTS

| | | | | |
|---|---|---|---|---|
| DE | 87 06 834.6 | U1 | | 8/1987 |
| DE | 3936872 | A1 | * | 5/1991 |
| DE | 10 2004 005 975 | A1 | | 8/2005 |
| EP | 0 078 206 | A | | 5/1983 |
| EP | 0 747 557 | A | | 12/1996 |
| EP | 1 217 157 | A | | 6/2002 |
| FR | 2 889 236 | A | | 2/2007 |
| RU | 2016184 | | | 7/1994 |
| SU | 1313990 | | | 7/2004 |
| WO | WO-00/66863 | A1 | | 11/2000 |

* cited by examiner

DOOR HINGE, IN PARTICULAR EDGE HINGE

BACKGROUND OF THE INVENTION

1. Technical Field

The invention relates to a door hinge, in particular an edge hinge, which has a door-mounted support and a support mounted on the door frame, both of which are designed such that they can be swiveled relative to each other around a common rotational axis.

2. Discussion

These types of door hinges are known for example from the document DE 10 2004 005 975 A1. They serve for the articulated arrangement of a door on a door frame. To this end each door hinge consists of a door-mounted support on the one side and a support mounted on the door frame on the other side. The door-mounted support and the frame-mounted support of each door hinge are so designed that they can be swiveled relative to each other by means of a common rotational axis. For the articulated arrangement of a door on a door frame two or three door hinges are normally used, and in the case of two door hinges a first one is arranged in the upper part and second one in the lower part of the door. Although the door hinges which are known from prior art have delivered an optimal performance in practice, there is a need for an improvement, especially with regard to a simplified assembly or disassembly and also with regard to a simplified handling.

Accordingly, it is an object of the present invention to provide a novel door hinge, in particular an edge hinge, which allows a simplified assembly or disassembly on the one side and a simplified handling on the other side.

To achieve this object the preferred embodiment of the invention proposes a door hinge, in particular an edge hinge, which is characterized in that the door-mounted support and the support mounted on the frame are identical in construction and are thus equally usable for left and right doors.

The door-mounted support and the frame-mounted support of the door hinge according to the preferred embodiment of the invention are constructed the same way and can thus be exchanged for each other. The door-mounted support can be used for the frame-mounted support and vice versa. Advantageously, the diversity of parts is thus kept low, which simplifies in particular the mounting of a door hinge according to the invention. A wrong mounting can be avoided as far as possible, at least concerning the parts that are used, because there is no more difference between the door-mounted support on the one side and the door frame-mounted support on the other side. The supports of the door hinge can be equally used for a door-mounted support or a frame-mounted support.

According to a further feature of the invention the door hinge has a height adjustment device. The height adjustment device allows the door-mounted support to be adjusted relative to the frame-mounted support in the longitudinal direction of the rotational axis of the door hinge, in order to be able to adjust the height of the door with regard to the door frame, if necessary. Thanks to the height adjustment device the door can be adjusted with regard to the door frame thus leveling in particular optically disturbing air gaps between the door on the one side and the door frame on the other side.

Thanks to the identical construction of the door-mounted support and the frame-mounted support the height adjustment device can be mounted both on the door-mounted support and on the frame-mounted support. For this reason the height adjustment device is so designed that it is mountable on the side of the door-mounted support or on the side of the frame-mounted support. Depending on the respective case of application or on the installation condition, the height adjustment device can thus be selectively arranged either on the frame-mounted support or on the door-mounted support, which advantageously makes the door hinge more easily accessible during its later intended use. In a door for instance which is articulated to the door frame by means of two hinges, it can be provided that the door hinge which is the upper hinge in the height direction of the door carries the height adjustment device in such a way that in this case the height adjustment device can be preferably accessed from below. The height adjustment device which is arranged on the lower door hinge is preferably accessible from the top.

The above-described construction of the door hinge according to the invention further offers the advantage that all the hinge parts are usable for right and left mounting, hence for left and for right doors.

According to a further advantage of the preferred embodiment of the invention the door-mounted support can be exchanged for a hinge plate in the case of flush doors or doors with only a slight overlap. Though in this case the door-mounted support and the frame-mounted supported are no longer identically constructed, the advantage of the hinge according to this aspect of the invention is that for a simplified mounting the door-mounted support can be exchanged for a hinge plate, if required. Since the door-mounted support that has been exchanged for a hinge plate is identical with the frame-mounted support, the spare door-mounted support can be used then in the assembly of a different door hinge, either as a door-mounted support or as a frame-mounted support. If the supports did not have an identical construction, any ulterior use of the door-mounted support, which has been replaced by a hinge plate and has thus become a spare part, would not be possible for lack of a matching frame-mounted support. This drawback is removed by the construction according to the invention in that the door-mounted support and the frame-mounted support are identically designed, thus allowing a spare door-mounted support that has been exchanged for a hinge plate to be equally used as a frame-mounted support. This reduces the number of spare parts that have to be carried along by the service personnel.

According to a further feature of the preferred embodiment of the invention the door hinge is equipped with rising hinge sleeves or non-rising hinge sleeves. Rising hinge sleeves can optionally have an incorporated pressure spring. This assists closing of the door and thus plays to a simplified use. Preferably the pressure spring is pre-mounted with the hinge sleeves, so that a one-piece component is produced which is combined of hinge sleeves on the one side and pressure spring on the other side. This combination of hinge sleeve and incorporated pressure spring constitutes a one-piece and thus easily exchangeable assembly which additionally has the advantage that the pressure spring needs not be cocked. This too simplifies mounting and demounting.

According to a further feature of an aspect of the invention the hinge axis of the door hinge forming the rotational axis is fixed at its end to a hinge sleeve. This construction has the advantage that the door hinge can be unhinged, if necessary. Namely the frame-mounted support can be simply pulled off the hinge axis in the height direction, thus allowing the door which is articulated to the door frame to be unhinged upwards.

According to a further feature of the invention the door hinge is designed for adjustment in three axes, so that it can be adjusted if necessary and thus easily mounted or subsequently adjusted.

According to a supplementary feature of the invention it can be further provided that the door hinge includes a lock against demounting. This serves as safeguard against manipulation.

BRIEF DESCRIPTION OF THE DRAWINGS

Further features and advantages of the invention will become apparent from the following description with reference to the attached drawing FIGS. 1 to 8.

These figures show in an exploded perspective view the door hinge according to the invention in the form of an edge hinge and detailed views of individual components of the door hinge according to the invention.

DETAILED DESCRIPTION OF THE INVENTION

Figure 1:
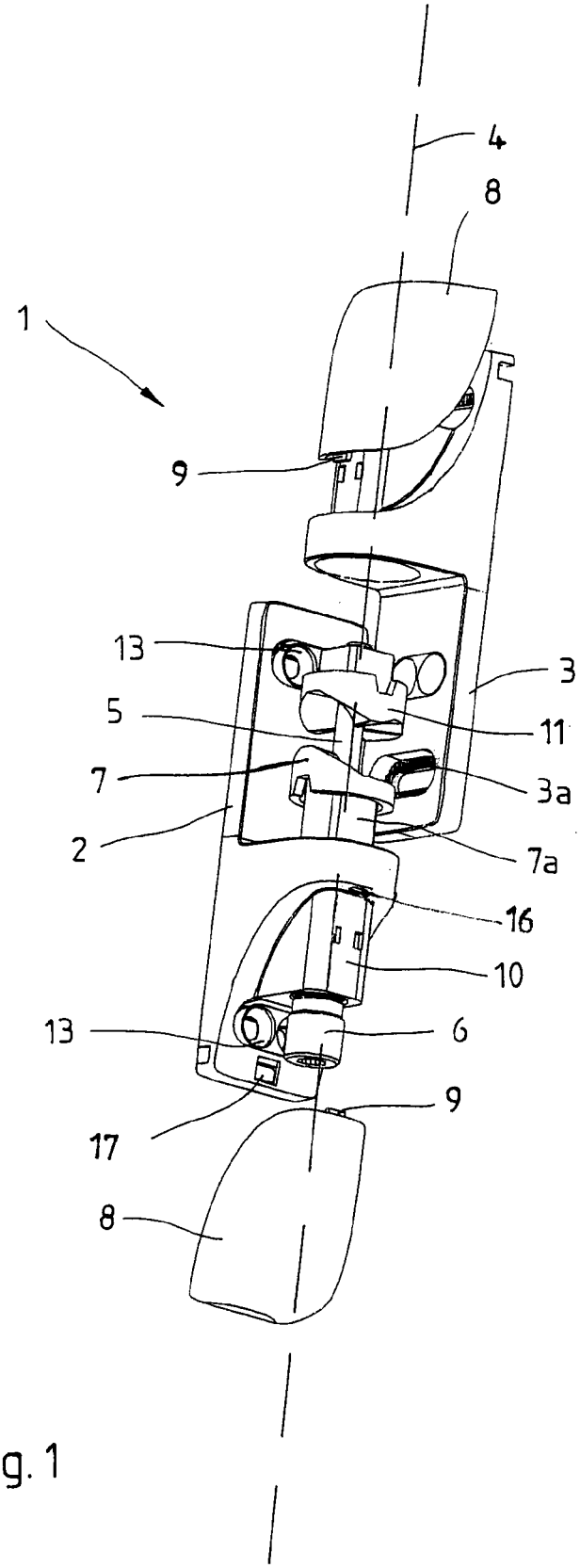

Reference number 1 in FIG. 1 generally designates a door hinge according to the invention. The door hinge 1 includes a support 2 intended for mounting on the frame, on the one side, and a support 3 intended for mounting on the door, on the other side. For reasons of clarity, both the door frame and the door are not shown in FIG. 1.

The frame-mounted support 2 and the door-mounted support 3 are designed for swiveling relative to each other about a common rotational axis 4. For this purpose a hinge axle 5 is provided connecting the frame-mounted support 2 to the door-mounted support 3.

According to the invention the frame-mounted support 2 and the door-mounted support 3 are identically constructed, thus offering the advantage for the frame-mounted support 2 to be exchanged for the door-mounted support 3. Hence the frame-mounted support 2 can be equally used for the door-mounted support 3 and vice versa. Thus the diversity of parts is advantageously reduced.

The hinge axle 5 is fixed at its end to a hinge sleeve 7 that is supported on its part by the frame-mounted support 2. The door-mounted support 3 having the hinge sleeve 11 is attached to the end of the hinge axle 5 opposite to the frame-mounted support 2 and is supported by the same for swiveling relative to the frame-mounted support 2 while following the weight force. This construction offers the advantage that the door-mounted support 3 is arranged for replacement on the frame-mounted support 2, thus allowing the door supported by the door-mounted support 3 to be unhinged upwards in the height direction of the rotational axis 4, if required.

Figure 2:
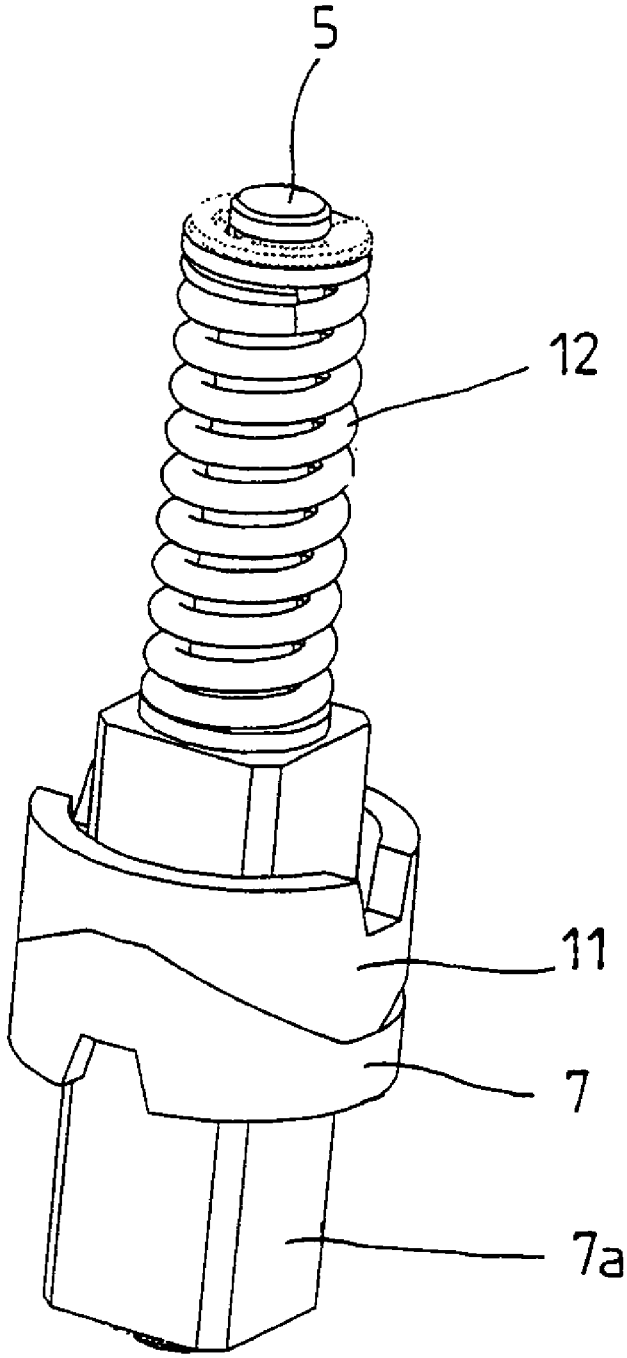

As already mentioned above, a hinge sleeve 7 provided on the frame-mounted support 2 serves for receiving the hinge axle 5 at the end thereof. If the hinge sleeve is of the rising type, a hinge sleeve 11 corresponding to the form of the riser is used in the door-mounted support. Due to the curve shape, the door is raised up to a certain angle of rotation during opening, in order to lift a bottom sealing present on the underside of the door off the floor and cause automatic closing of the door by the weight of the door. This closing effect can be assisted as illustrated in FIG. 2 by a spring 12 combined into a unit together with the two sleeves 7 and 11, the hinge axle 5 and the locking elements. If required, the spring unit can be subsequently exchanged for the standard sleeves that are installed. Because of the pre-assembly, the spring needs not be cocked. In the non-rising type of the hinge both hinge sleeves are identically constructed and their contact surfaces are plane.

The door hinge 1 further comprises a height adjustment device 6 allowing the door-mounted support 3 to be positioned relative to the frame-mounted support 2 in the height direction of the rotational axis 4 thus providing for the possibility to adjust the door supported by the door-mounted support 3 relative to the door frame. The height adjustment device 6 acts upon the hinge sleeve 7, which for this purpose includes a guide element 7*a* which is inserted in the seat 10 of the frame-mounted support 2. The height adjustment device 6 can be so designed that it is mountable both on the side of the door-mounted support and on the side of the frame-mounted support, so that the height adjustment device 6 is accessible either from the top or from the bottom with regard to the door leaf plane according to FIG. 1, depending on the installation situation.

As a protection against demounting of the supports for the purpose of housebreaking, closing caps 8 are provided which can be arranged by means of correspondingly constructed locking devices 9 and 15 in openings 16 and 17 formed on the frame-mounted support 2 or on the door-mounted support 3. These cover caps 8 also cover the height adjustment device 6 and the otherwise visible screwing means 13, thus providing for an overall aesthetic appearance. The cover caps 8 can be made of plastic or metal. The use of plastic is however preferred.

The screwing means 13 are plates which preferably have a detent structure on their underside and which can be laterally displaced relative to their supporting surface 3*a* in the respective support, so that a lateral adjustment of the door is possible. The screwing means 13 are connected to the door or the frame by means of screws.

Figure 3:
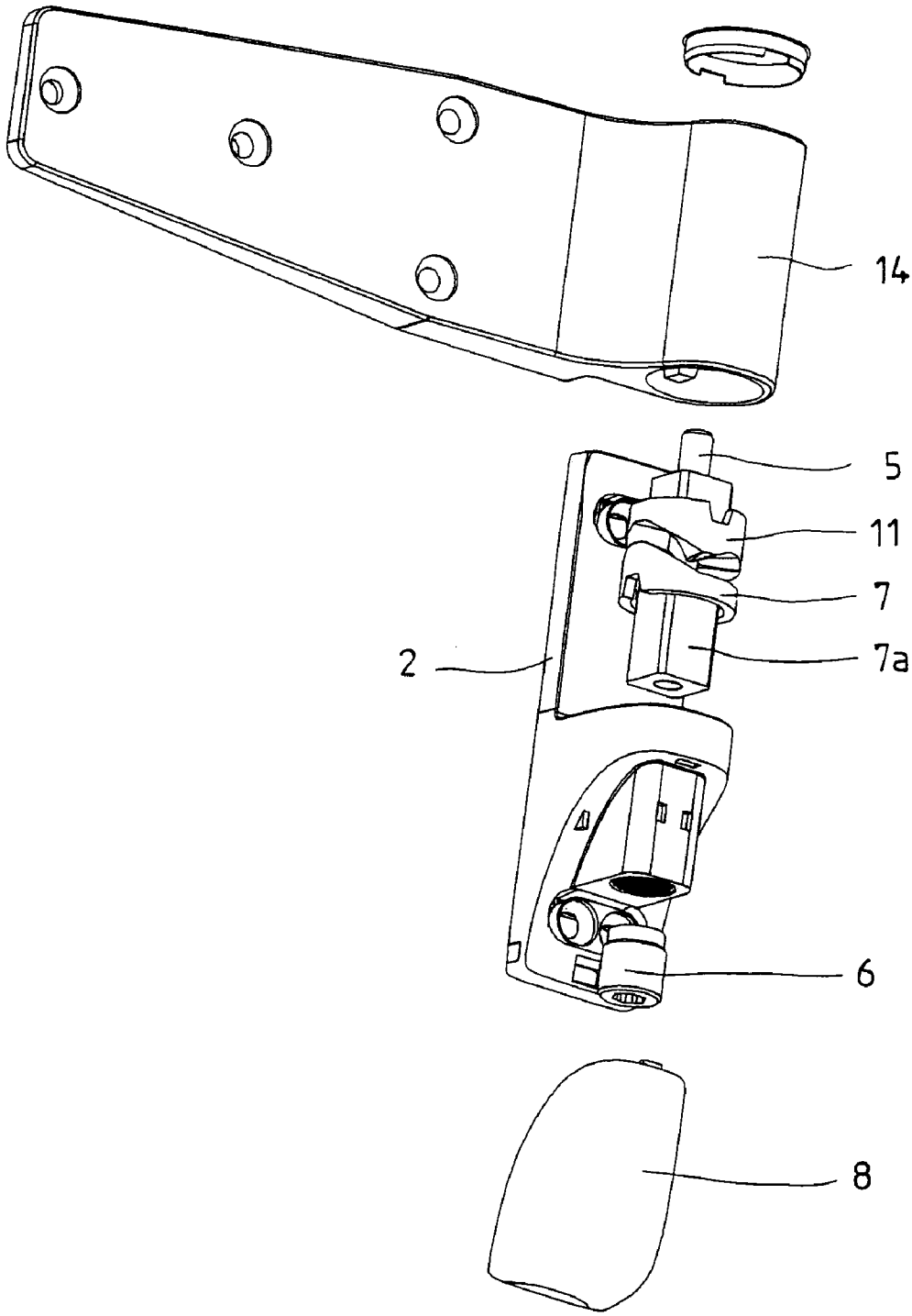

FIG. 3 illustrates an embodiment in which the door-mounted support 3 is replaced by a hinge plate 14.

The cover caps 8 are arranged on the frame-mounted support 2 or on the door-mounted-support 3 preferably protected against disassembly, for which purpose an anti-tamper bolt 20 is used, as shown in FIGS. 4 to 8.

For its arrangement on the frame-mounted support 2 or on the door-mounted support 3 the cover cap 8 includes locking means 9 and 15 which in the mounted condition engage in openings 16 and 17 provided on the frame-mounted support 2 or on the door-mounted support 3.

Figure 4:
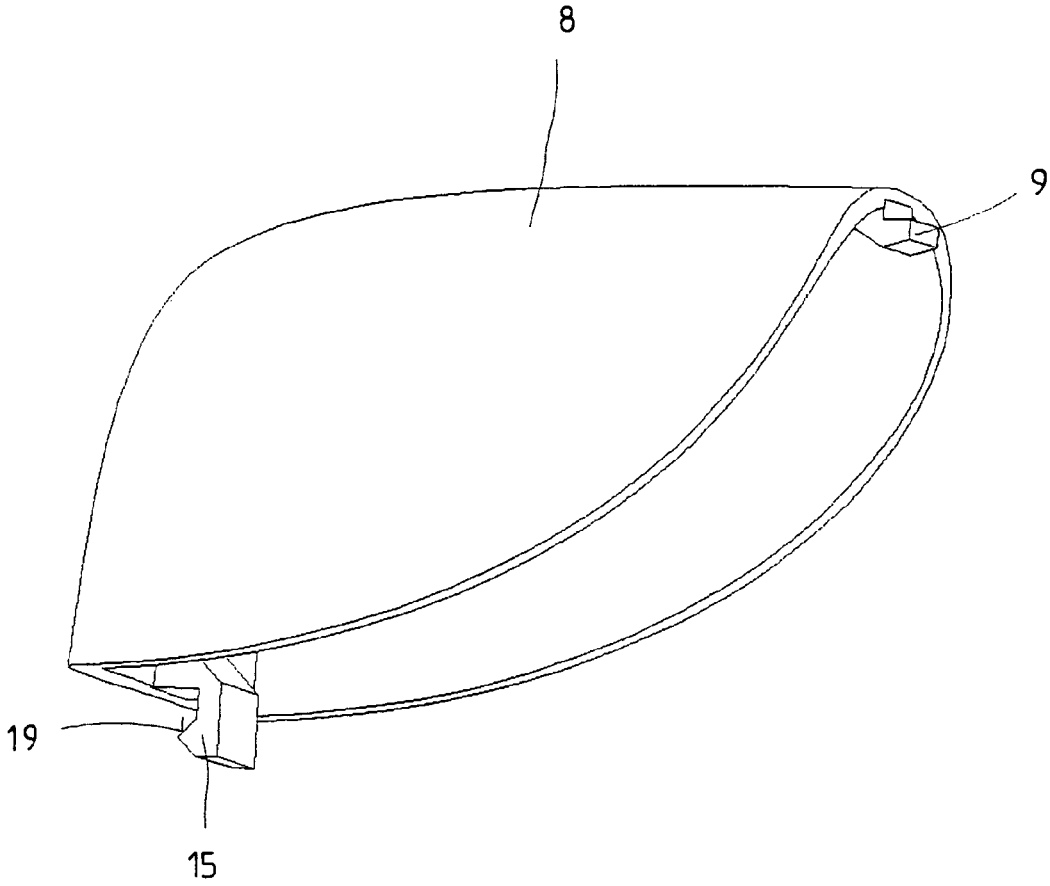
Figure 5:
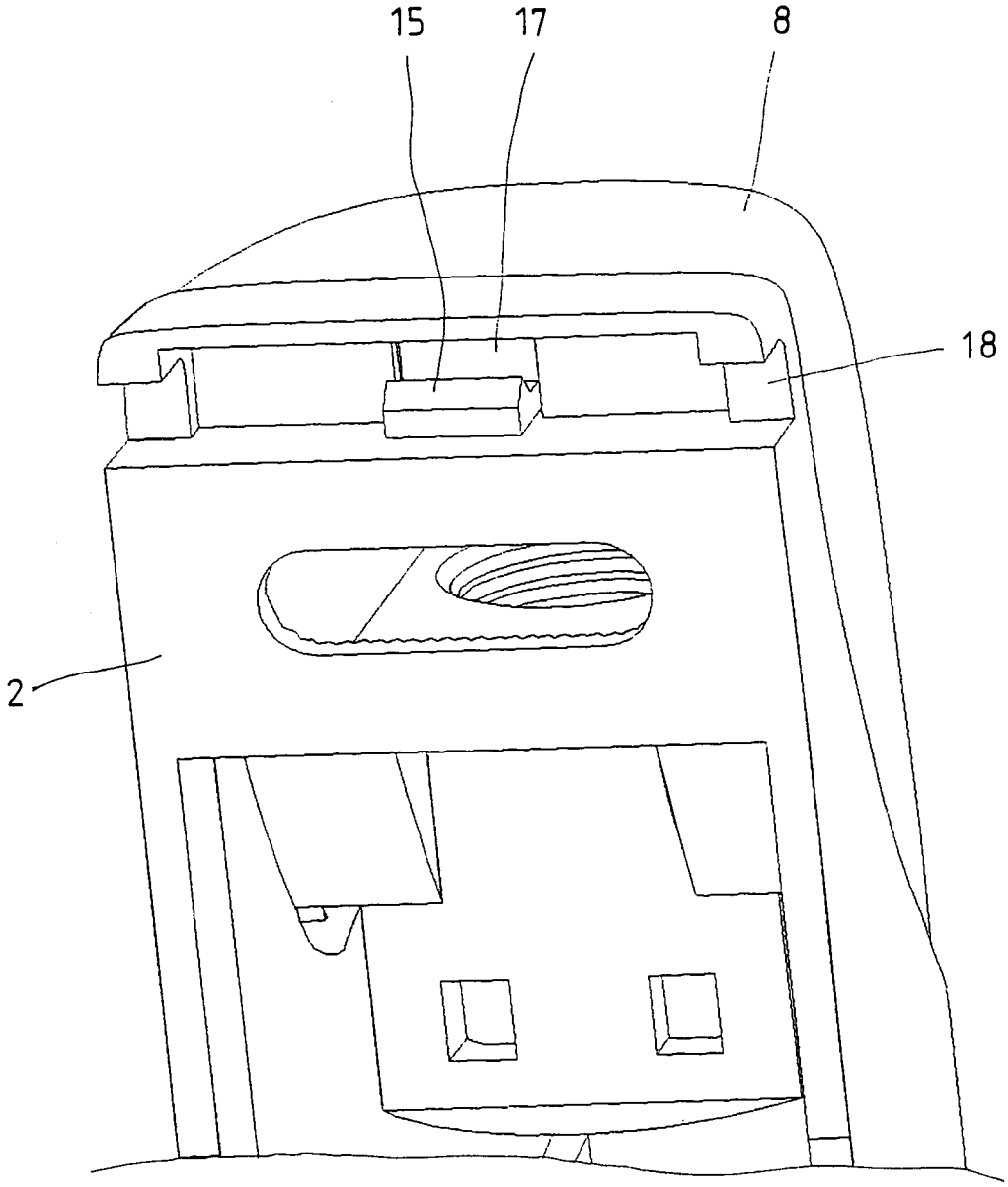

As it can be seen especially in FIG. 4, the locking means 15 arranged on the cap 8 is designed as a hook-like appendix including an inclined wedge surface on the side of the frame-mounted support or on the side of the door-mounted support. For mounting the cover cap 8, the locking means 9 arranged on the cover cap 8 is first inserted in the opening 16 that is provided for this purpose on the frame-mounted support 2 or on the door-mounted support 3. Then the cover cap 8 is pivoted towards the frame-mounted support 2 or towards the door-mounted support 3, until the locking means 15 which is designed as a hook-like appendix becomes locked in the opening 17 provided for this purpose on the frame-mounted support 2 or on the door-mounted support 3. FIG. 5 shows parts of a mounted cover cap 8 in a rear view to the frame-mounted support 2 for example.

Figure 6:
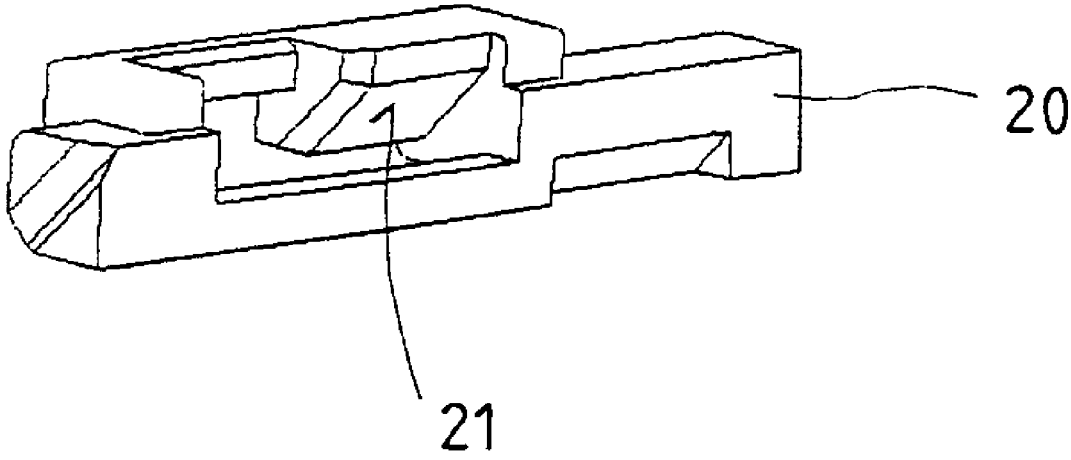

As further shown in FIG. 5, a channel or groove-like recess 18 extending transversely to the longitudinal extension of the frame-mounted support 2 is provided on the rear side of the frame-mounted support 2 facing away from the cover cap 8. In this recess 18 the anti-tamper bolt 20 shown in FIG. 6 is inserted for the final mounting of the cover cap 8.

Figure 7:
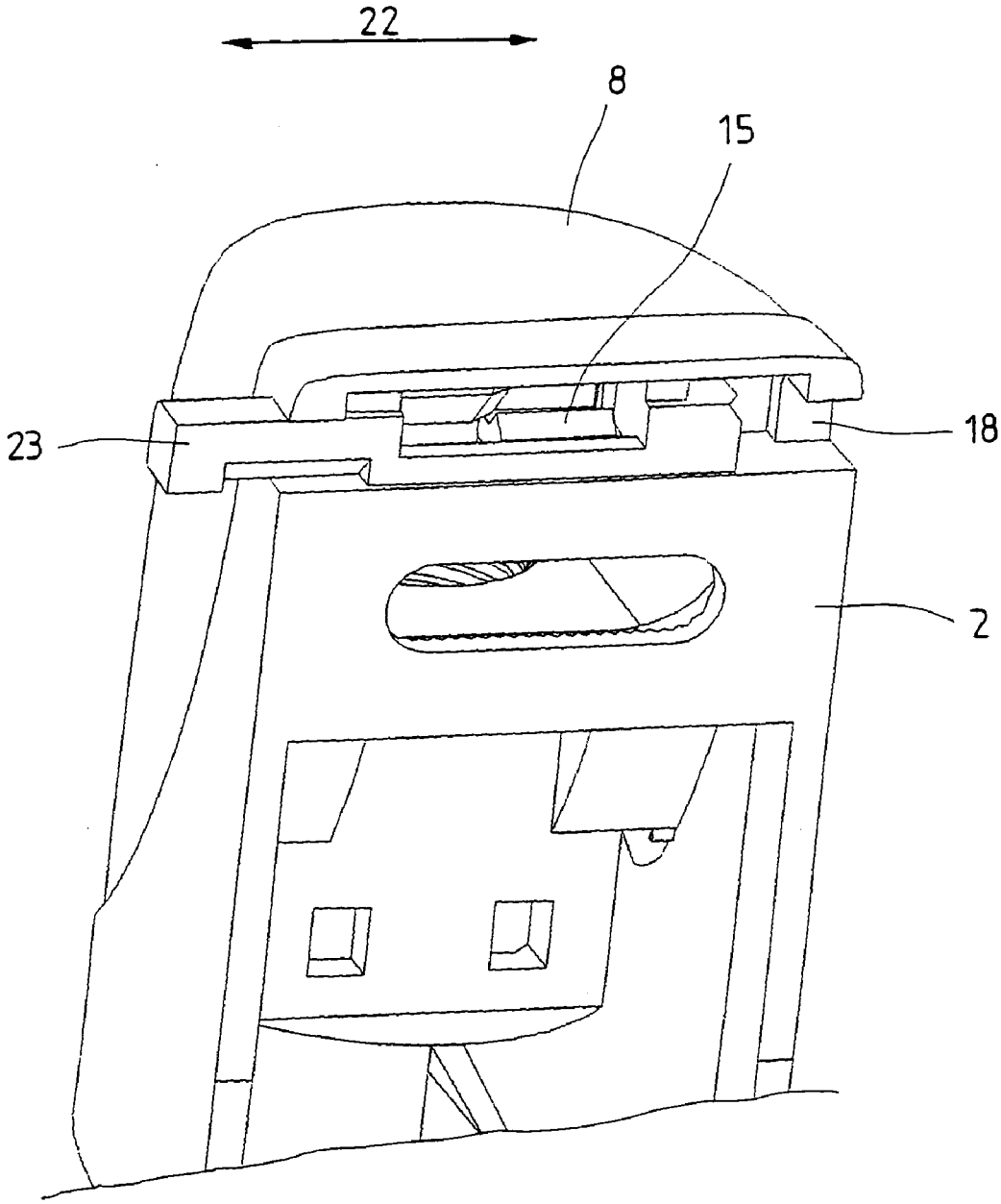

The anti-tamper bolt 20 is arranged for displacement in the longitudinal direction 22 of the groove-like recess, as it is shown especially in FIG. 7.

The anti-tamper bolt 20 has a counter surface 21 corresponding to the wedge surface 19 of the locking means 15 of the closing cap 8. In the finally mounted state the counter surface 21 of the anti-tamper bolt 20 grips behind the wedge surface 19 formed on the locking means 15. In this position of the anti-tamper bolt 20 the cap 8 is fixed in its position on the frame-mounted support 2 or on the door-mounted support 3.

Figure 8:
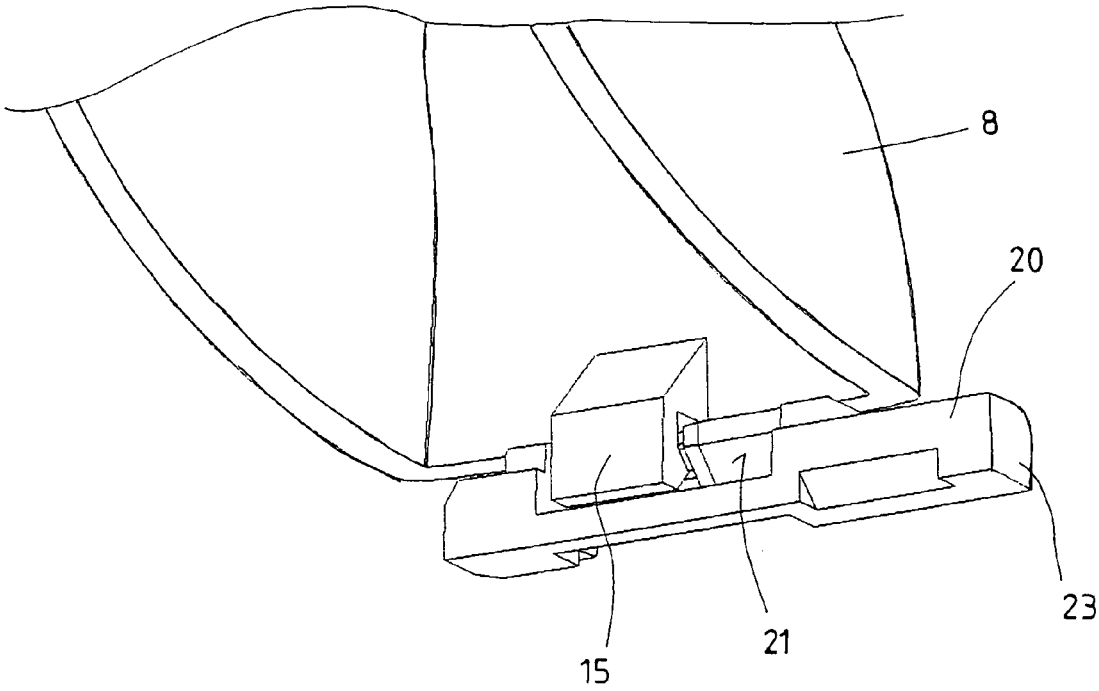

It can be seen especially in FIGS. 7 and 8 that the anti-tamper bolt 20 can be inserted in the groove-like recess 18 from the left or from the right with regard to the respective drawing plane. Depending on whether the door opens to the right or to the left, the anti-tamper bolt 20 is inserted in the groove-like recess 18 in such a way that the longer, thin end 23 of the anti-tamper bolt 20 points away from the door. In the closed condition of the door, the anti-tamper bolt 20 can be moved to the closed position, until the end surfaces are congruent with the outer skin of the frame-mounted support 2 or of the door-mounted support 3.

Thus the anti-tamper bolt 20 can be displaced to the open position only if the door is open, because the end surface of the anti-tamper bolt 20 can be accessed in this position only. Thus protection is provided against disassembly, and any unauthorized opening of a closed or locked door by unscrewing the frame-mounted support 2 or the door-mounted support 3 is made difficult.

The invention claimed is:

1. A door hinge, in particular an edge hinge, comprising a door-mounted support and a support mounted on a door frame, both of which are designed such that they can be swiveled relative to each other around a common rotational axis, wherein the door-mounted support and the frame-mounted support are identically constructed and equally usable for left and right doors, and wherein the door hinge further includes cover caps arranged at ends of the frame-mounted support and the door-mounted support, the cover caps having a locking mechanism which in the mounted condition fit in openings provided on the frame-mounted support and the door-mounted support, and wherein a rear side of each of the supports facing away from the cover caps has a recess therein in which an anti-tamper bolt is inserted, said locking mechanism including a wedge surface and said anti-tamper bolt includes a counter surface, the counter surface of the anti-tamper bolt gripping the wedge surface of the locking mechanism to resist removal of the caps and disassembly of the supports.

2. A door hinge according to claim 1, further comprising a height adjustment device for mounting on the door-mounted support or to the frame-mounted support.

3. A door hinge according to claim 1, further comprising exchangeable hinge sleeves having a pressure spring therein.

4. A door hinge according to claim 1, wherein a hinge axle forming the rotational axis is fixed at one end to a hinge sleeve.

5. A door hinge according to claim 1, wherein at least one of said supports is a symmetrical hinge plate that can be equally used for right and left doors by changing doors.

6. A door hinge comprising: a door mounted support for mounting on a door and a support mounted on a door frame that swivel relative to each other about a common rotational axis, at least one of the supports having at least one opening therein, the at least one support further including a recess that communicates with the at least one opening;

a cover cap for the at least one support, the cover cap having a locking mechanism that fits in the at least one opening on the support; and wherein the recess is located in a rear side of the at least one support facing away from the cover cap;

an anti-tamper bolt inserted in the recess; and said locking mechanism including a wedge surface and said anti-tamper bolt including a counter surface, the counter surface of the anti-tamper bolt gripping the wedge surface of the locking mechanism to resist removal of the cap and disassembly of the at least one support.

7. The door hinge of claim 6 wherein: said anti-tamper bolt is in a locked position when the door is in a closed condition to prevent disassembly of the support when the door is in the closed condition, and wherein said anti-tamper bolt can be displaced to an open position when the door is in an open condition.

8. The door hinge of claim 6 wherein: the counter surface of the anti-tamper bolt prevents movement of the wedge surface of the locking mechanism through the at least one opening when the anti-tamper bolt is in a locked position.

9. The door hinge of claim 6 wherein the door mounted support for mounting on a door and the support mounted on a door frame are identically constructed.

* * * * *